United States Patent [19]

Bessho

[11] 4,321,818

[45] Mar. 30, 1982

[54] CLOSED FORGING PRESS

[75] Inventor: Michio Bessho, Himeji, Japan

[73] Assignee: Kawaski Yukon Kabushiki Kaisha, Hyogo, Japan

[21] Appl. No.: 81,364

[22] Filed: Oct. 3, 1979

[51] Int. Cl.[3] ..... B21J 9/12

[52] U.S. Cl. ..... 72/453.02; 72/354; 72/358; 72/360; 72/400

[58] Field of Search ..... 72/453.02, 453.03, 453.11, 72/407, 402, 400, 401, 453.01, 453.18, 353, 358, 360, 354

[56] References Cited

U.S. PATENT DOCUMENTS

| | | | |
|---|---|---|---|
| 2,182,663 | 12/1939 | Eby | 72/402 |
| 3,210,984 | 10/1965 | Arbogast | 72/402 |
| 3,357,228 | 12/1967 | Harrison | 72/354 |
| 3,651,685 | 3/1972 | Tominaga | 72/453.01 |
| 3,680,381 | 8/1972 | Portal | 72/354 |
| 4,148,209 | 4/1979 | Bessho | 72/453.03 |

*Primary Examiner*—Gene Crosby

*Attorney, Agent, or Firm*—Munson H. Lane; Munson H. Lane, Jr.

[57] ABSTRACT

In a hydraulic forging press having one or a plurality of press rams actuated reciprocatively through working oil by reciprocating motion of pump ram given by mechanical driving means, a closed forging press being provided with one or a plurality of punch rams disposed in a position to communize said working oil with said press ram and perform double action with said press ram, and actuated through said working oil by reciprocating motion of said pump ram.

1 Claim, 6 Drawing Figures

CLOSED FORGING PRESS

PRIOR ART

Applicant is not aware of any pertinent prior art other than applicant's U.S. Pat. No. 4,148,209 referred to hereinafter.

SUMMARY OF THE INVENTION

The present invention relates to a so-called hydraulic forging press and, more particularly, to a closed forging press provided with one or a plurality of punch rams whose performance system has been improved and further enhanced in the yield rate of a material.

It is well known in the art relating to a closed forging press that a metallic material is forged and closed completely by a pair of segment dies, in some cases being roughly forged preliminarily as a primary process, wherein one or a plurality of punch rams are pushed in a double action manner into the segment dies that have been closed completely or are being closed and as the result said metallic material is pressed hard against an inner complex-shaped wall of the segment dies. It is also well known that compared to a conventional simple stamp forging system, this forging system has such advantageous features as enhancement in the yield rate, obtainability of more complex and precise forming, retrenchment of pressing power and reduction of overall weight herewith.

But in the present conditions as a high efficient and simple method has not been realized yet in the performance system of a punch ram or/and in the combination performance of a punch ram and a press ram for the primary process, an extremely complex and low efficient system is placed at a service.

Describing briefly the basic construction of the invention made by the present inventor about the improved hydraulic forging press having both advantages of a mechanical press and of a hydraulic press, such as that which is described in U.S. Pat. No. 4,148,209 issued Apr. 10, 1979, the said hydraulic press has a pump ram inserted into the upper part of a cylinder, a press ram inserted into the lower part thereof and a cavity filled with working oil provided between the both parts of cylinders for transmitting the reciprocating motion given mechanically by a mechanical driving means, for instance a rotatable crank mechanism, to the press ram.

Thereupon, the present inventor hit on the idea that the above-mentioned demerits and defects in a conventional closed forging press could be eliminated when the working oil provided in said hydraulic forging press would be utilized to actuate the punch ram for a punch as well as the press ram in the closed forging press, and then this invention has been made accordingly.

It is therefore an object of the present invention to provide a closed forging press capable to powerfully operate the dies to be opened and closed and the punch to be pushed in and pulled out at high speed as well as with high precision.

It is another object thereof to provide a press in which it is not necessary to produce any sheet-shaped material pressed out at the joining surface of segment dies i.e. any flash, accordingly which enhances the yield rate of a material exceptionally.

It is still another object thereof to provide a press capable to adjust the punch pushing-in distance automatically by utilizing the compressibility of working oil.

Figure 1:
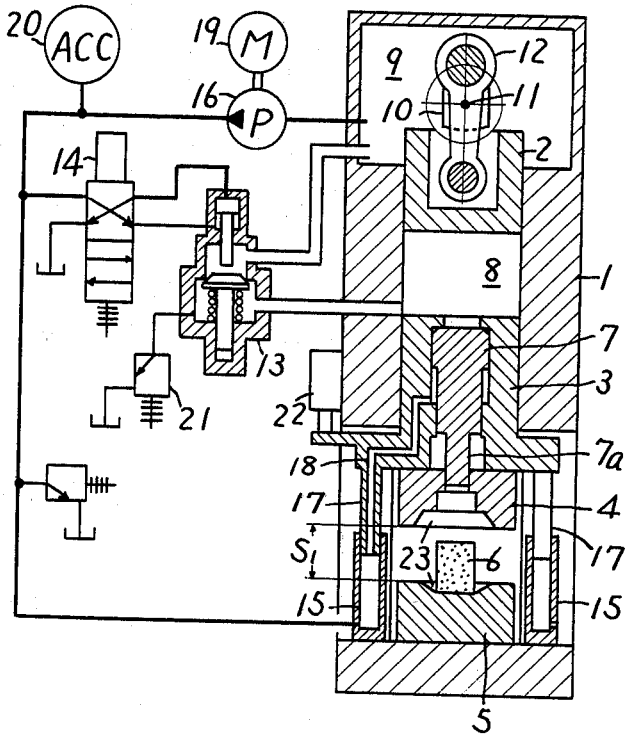
FIG. 1 shows a longitudinal sectional view and a schematic diagram of one embodiment according to the present invention.

THE DRAWING INCLUDES THE FOLLOWING ELEMENTS:

1, 25—cylinder
2—pump ram
**3, 3*a*, 3*b***—press ram
4—upper die
5—lower die
6—material
7, 24—punch ram
8—cavity
9—reservoir
10—crank
11—axle
12—connecting rod
13—check valve
14—change-over valve
15—return cylinder
16—pump
17—push-up ram
18—passage
19—motor
20—pressure accumulator
21—relief valve
22—upper limit stopper
23—cavity
26, 27, 28, 29, 30—conduit

DETAILED DESCRIPTION

Figure 3:
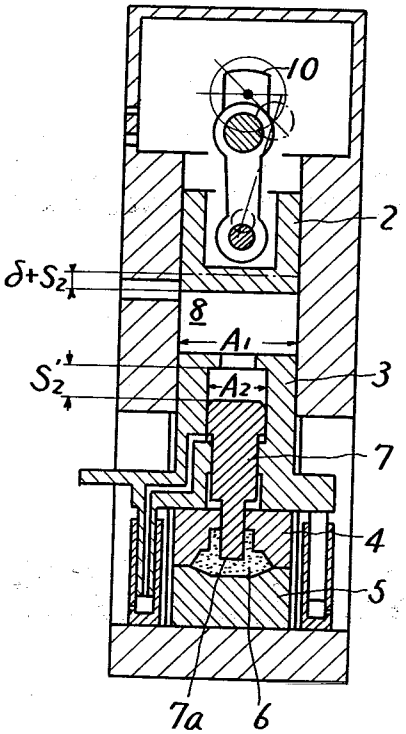

Then, referring to the drawings showing embodiments of the present invention, the construction of the forging press will be described in detail as follows:

In the drawings from FIG. 1 to FIG. 4, numeral 1 indicates the cylinder of a forging press which includes pump ram 2, press ram 3 and a pair of segment dies consisting of upper die 4 and lower die 5. In this preferred embodiment, both diameters of the pump ram 2 and the press ram 3 are the same in dimension unexpectedly. It is the profile of metallic material 6 before being forged that is shown in FIG. 1 and the profile after being forged that is shown in FIG. 3 and in FIG. 4. Still in this preferred embodiment punch **7*a* formed at the end of punch ram 7 kept within said press ram 2 is designed to move through the upper die 4 along the axle line of the cylinder 1 reciprocatively. A crank 10 rotating around the axle 11 gives the reciprocating motion along the axle line of the cylinder 1 to the pump ram 2 by means of connecting rod 12 as a mechanical driving means. Meanwhile, numeral 13 indicates the check valve which is controlled by change-over valve 14 to circulate the working oil between cavity 8 and reservoir 9 and keep an oil pressure in said cavity 8 during the press working. As to be understood readily from above-mentioned construction, both the press ram 3 and the punch ram 7 are actuated by the same working oil in the cavity 8 constructively, namely they communize the working oil in common. In the return cylinder 15 the oil pressure transmitted from pump 16 driven by motor 19** acts on push-up ram 17 to return the press ram 3 and also to return the punch ram 7. There is a pressure accumulator 20 and a relief valve disposed in the output line from said pump 16. Relief valve 21 controls the maximum oil pressure in the cavity 8. Numeral 22 indicates the upper limit stopper for the press ram 3, whose upper limiting position can be easily and discretionally adjusted constructively. (The construction of this stopper is equal to that shown in U.S. Pat. No. 4,148,209 issued Apr. 10, 1979). The distance between upper die 4 and the lower die 5, i.e. the stroke S1 of the press ram 3 from its opened position to its closed position is set up by this upper limit stopper 22 in consideration of the punch ram 7 stroke only after the closure of said both dies and the compressibility of the working oil.

Figure 2:
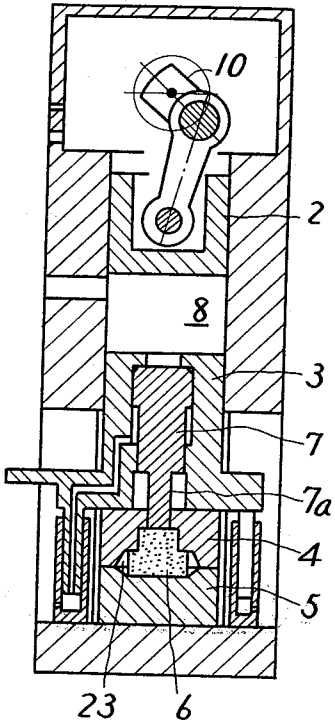

Now the forging process for the material 6 as the performance of the closed forging press according to the present invention will be described:

The process of the forging work is shown sequentially from FIG. 1 to FIG. 4. FIG. 2 shows the state that cavity 23 of the segment dies is closed completely when the upper die is pushed down the stroke distance S1 onto the lower die tightly by the press ram 3 as a result of the crank 10 rotation towards clockwise direction from the position shown in FIG. 1, whereby the material 6 is forced to the primary plastic deformation just like shown in the drawing.

And then FIG. 3 shows the state that said crank 10 further rotates and comes to so-called the bottom dead center. The press ram 3 in FIG. 2 is already at the end position of its descending stroke, therefore during the duration from the state in FIG. 2 to that in FIG. 3 only the working stroke of the punch ram 7 is carried out.

Meanwhile the necessary pump stroke $S2+\delta$, where $\delta$ is negligible with comparison to S2 against the punch ram stroke S2' is related as follows:

$$S2 = \frac{A2}{A1} S2'$$

Where:

A1=cross sectional area of the pump ram 2

A2=cross sectional area of punch ram 7

Accordingly the descending velocity of the punch ram 7 is much faster than that of the press ram 3. Namely, against the velocity v1 of the press ram 3 at the time of segment dies being closed, the pushing-in velocity v2 just thereafter is related as follows:

$$v2 \doteqdot \frac{A1}{A2} v1$$

This velocity v2 is far and away fast compared with that of a conventional closed forging press. This condition functions effectively to prevent the punch 7*a* from losing its strength and reducing its service life by the heat transmitted from the hot material 6. As shown in the drawing, when the punch 7*a* pushes into the material, every nook and corner of the cavity 23 is filled up with said material due to the pushing force by said punch 7*a*.

It is ideal that the work to fill up the cavity 23 completely with the material 6 is finished at the same time as the crank 10 reaches to the bottom dead center (B.D.C.). But ordinarily it is practically important to adjust the performance parameters so that the said filling up work is finished a little while before the crank 10 reaches to the B.D.C. and to aim the above-mentioned work at perfection. And the punch ram 7 also stops properly when this filling up work is finished. However the stopping position of the punch ram 7 is usually deviated in a considerable extent depending on the error of weighing the material 6. The descending movement of the pump ram 2 from said stopping position to the B.D.C. of the crank 10 is converted to the work that compresses the working oil in the cavity 8. Whereby compared with the total volume of the working oil in the cavity 8, the compressed volume of said working oil is relatively quite a little, therefore the rising rate of the working oil pressure is comparatively insensible. For instance during the pressure rising to max. 485 kg/cm$^2$ the working oil in the cavity 8 is compressed the distance equivalent to the stroke of 11 mm to the pump ram diameter. If the punch descending movement is blocked at the position of 5 mm before the normal B.D.C., the additional pressure rise therefore is estimated about as follows:

$$485\ \text{kg/cm}^2 \times \frac{5}{11} \times \left(\frac{15''d}{26''d}\right)^2 = 73\ \text{kg/cm}^2$$

In this case, when the normal operating pressure is set at 400 kg/cm$^2$, the working oil pressure goes up to ab. 473 kg/cm$^2$. The pressure rise of this grade gives nothing harmful to this type of press machines. But in the case that the size of a material to be forged is too large or that the working oil pressure goes up more than the predetermined limit value by other abnormal conditions, the relief valve 21 naturally acts to protect the whole apparatus of the press machines by releasing the excess amount of pressurized oil.

Figure 5:
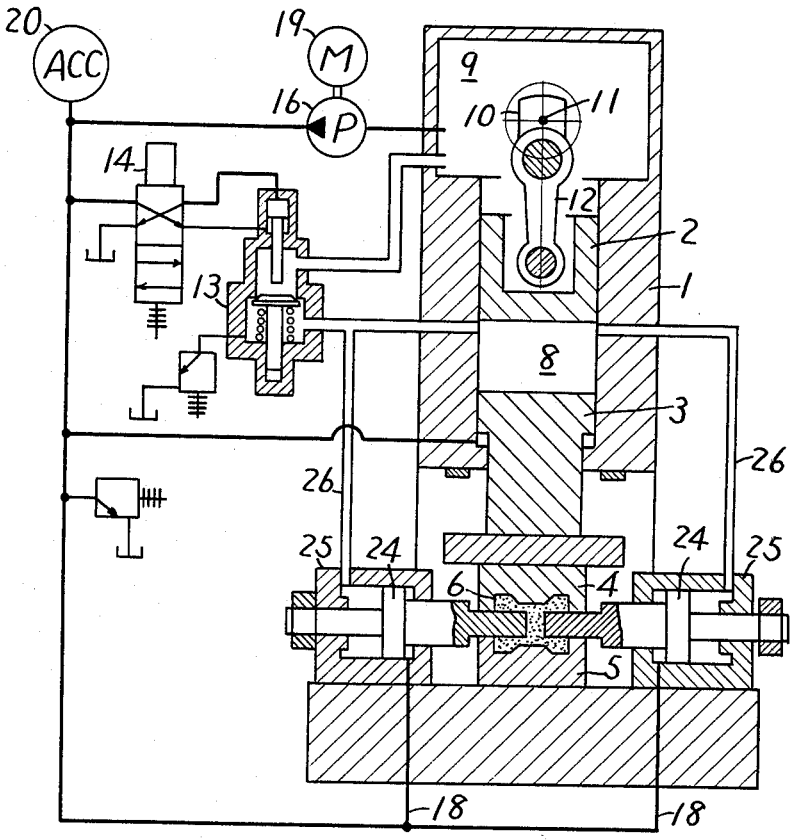
FIG. 5 and FIG. 6 show respectively second and third embodiments.
Figure 4:
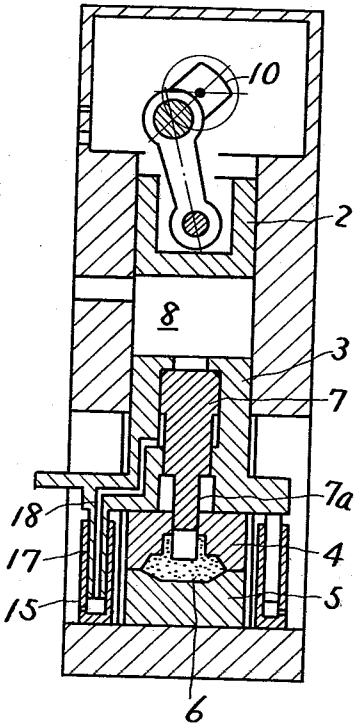
FIG. 2, FIG. 3 and FIG. 4 show respectively the sequential performance steps of said one embodiment thereof.

Then FIG. 4 shows such a state as the crank 10 further rotates and the pump ram 2 is on the way of its ascending stroke. Under this state, since the effective area in the oil passage 18 for the ascension of the punch ram 7 is set up so that first of all the punch ram 7 starts to be pushed up and returned relatively within the press ram 3 by the oil pressure in the return cylinder 15, the punch 7*a* is pulled out from the material 6 with the upper die 4 and the lower die 5 kept in tight touch each other and then the press ram 3 is caused to ascend by the action of the push-up ram 17 thereafter. Even in the case it is easily understood from the above-mentioned explanation about the descent of the punch ram 7 and the pump ram 2 that the ascending velocity of the punch ram 7 is much faster than that of the pump ram 2. In the another exemplary embodiment shown in FIG. 5, a plurality of punch rams 24 are provided so as to be operated in the horizontal directions. As the cylinders 25 for the punch rams 24 are connected to the cavity 8 by means of the conduits 26, this construction is equal to that shown in FIG. 1 in relation to the communication of the working oil. Other arrangement and construction of the above embodiment is equal to those in FIG. 1 and each of the numeral symbols is also indicated in common with that in FIG. 1.

From the other point of view, the construction shown in FIG. 1 can be modified like as that one more assembly of a punch ram is possibly disposed in the position against the punch ram 7 so as to operate punches from both upper side and lower side.

Figure 6:
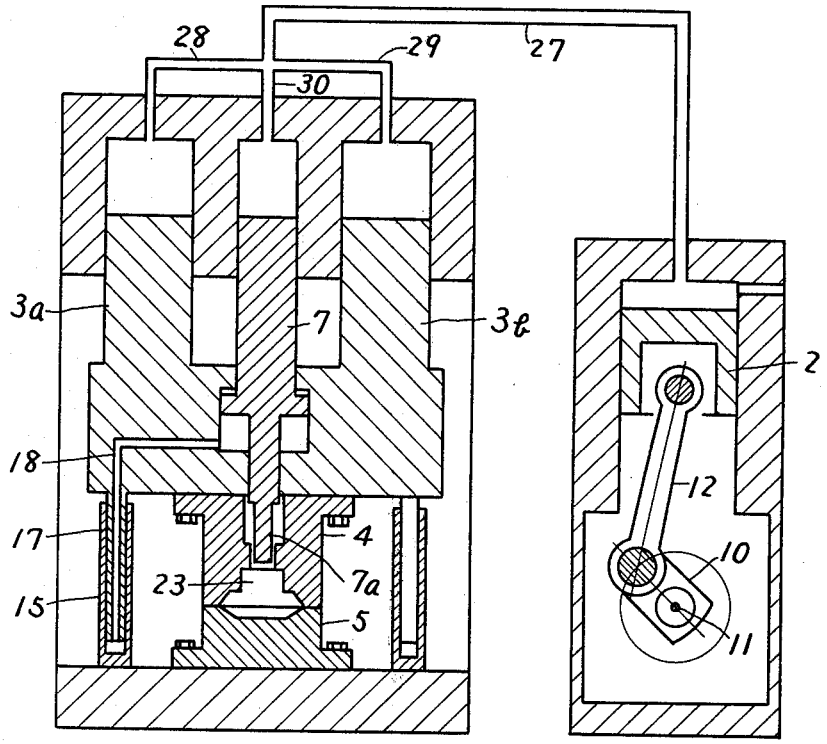

The further other exemplary embodiment shown in FIG. 6 is the type such as the pump portion and the press portion are separated independently each other. Two blocks of press ram 3*a* and 3*b* and one block of punch ram 7 interposed therebetween are connected to the pump ram 2 by means of the conduits 27, 28, 29 & 30 and disposed in the relation to communizing the working oil. The arrangement and the construction in the other portion is equal to those shown in FIG. 1 and the numeral symbols in FIG. 6 are applied correspondingly to those in FIG. 5.

As the closed forging press according to the present invention has the above-mentioned construction, the following characteristic effectiveness can be described:

(1) It is possible to perform the powerful and precise closed forging press by the very simple means and method.

(2) It is possible to produce none of flash of a material at a joining surface of the segment dies. This matter contributes to reduce the power expended for the actuation of the press as well as to enhance the yield rate of the material comparing with the conventional method to produce some flash in order to release the excess quantity of the material.

(3) As the punch pushing-in distance is fitted automatically by utilizing the compressibility of the working oil, the adjusting mechanism and method is very simple and safe.

(4) As the punch velocity for pushing-in and pulling-out can be made faster than the press ram velocity, it is possible to relieve the strength dropping and the service life shortening of the punch by heat.

The closed forging press according to the present invention is applicable to a cold forging as well as hot forging.

What is claimed is:

1. In a hydraulic forging press having at least one press ram actuated reciprocatively through working oil by reciprocating motion of a pump ram given by mechanical driving means, a closed forging press being provided with at least one punch ram disposed in a position to communize said working oil with said press ram and perform double action with said press ram, and actuated through said working oil by reciprocating motion of said pump ram, said press ram and said punch ram being actuated in common by said working oil in the relation that said press ram and said punch ram communize said working oil in the state that said working oil is kept sealed in a cavity provided between said pump ram and said press ram and said punch ram during actuating of said working oil on the pressure areas of said punch ram and said press ram so that said working oil of said state continues to actuate said punch ram after finishing of the working of said press ram, said hydraulic forging press including a cylinder, said pump ram being reciprocatively mounted in one end of said cylinder and said press ram and said punch ram being reciprocatively mounted in the other end of said cylinder, with space between said pump ram and said press and punch rams filled with working oil and forming said cavity, and said punch ram being reciprocatively mounted in said press ram with one end open to said cavity whereby the working oil in said cavity is in working communication with said punch ram.

* * * * *